US010542775B2

(12) United States Patent
Besso et al.

(10) Patent No.: US 10,542,775 B2
(45) Date of Patent: Jan. 28, 2020

(54) RESEALABLE TOBACCO POUCH

(71) Applicant: PHILIP MORRIS PRODUCTS S.A., Neuchatel (CH)

(72) Inventors: Clement Besso, Neuchâtel (CH); Pieter Van Lancker, Merelbeke (BE); Bart Bruggeman, Bornem (BE); Thomas Valcke, Kortrijk (BE)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/307,861

(22) PCT Filed: Jun. 23, 2017

(86) PCT No.: PCT/IB2017/053769
§ 371 (c)(1),
(2) Date: Dec. 6, 2018

(87) PCT Pub. No.: WO2018/002796
PCT Pub. Date: Jan. 4, 2018

(65) Prior Publication Data

US 2019/0183174 A1 Jun. 20, 2019

(30) Foreign Application Priority Data

Jun. 30, 2016 (EP) ..... 16177292

(51) Int. Cl.
*B65D 85/10* (2006.01)
*A24F 23/02* (2006.01)
(Continued)

(52) U.S. Cl.
CPC ..... *A24F 23/02* (2013.01); *B65D 33/1691* (2013.01); *B65D 33/25* (2013.01); *B65D 33/30* (2013.01)

(58) Field of Classification Search
CPC .... B65D 33/30; B65D 33/25; B65D 33/1691; A24F 23/03
(Continued)

(56) References Cited

U.S. PATENT DOCUMENTS 5,037,138 A * 8/1991 McClintock ..... B65D 33/24 383/210
5,934,806 A * 8/1999 Tomic ..... B26F 1/08 24/DIG. 50
(Continued)

FOREIGN PATENT DOCUMENTS

DE 3829181 A1 8/1990
EP 2551211 A1 1/2013
(Continued)

OTHER PUBLICATIONS

Extended European Search Report, issued by the European Patent Office for EP 16177292.6, dated Jan. 5, 2017; 6 pgs.
(Continued)

*Primary Examiner* — Luan K Bui
(74) *Attorney, Agent, or Firm* — Mueting, Raasch & Gebhardt, P.A.

(57) ABSTRACT

A packaged tobacco product includes a pouch and tobacco material disposed in the pouch. The pouch has a front wall and a back wall connected to one another along opposing first and second side edges. The pouch is configured to be opened along a top portion of the pouch to form an opening to provide access to the tobacco material in the pouch. The pouch includes a closure assembly having first and second releasably attachable parts. The first part is on the front wall of the pouch. The second part is on either the front wall or the back wall of the pouch. The second part is closer to the opening than the first part. When the first and second parts are attached, a portion of the back wall wraps around at least
(Continued)

a portion of the second part of the closure assembly to seal the pouch.

15 Claims, 3 Drawing Sheets

(51) Int. Cl.
*B65D 33/30* (2006.01)
*B65D 33/16* (2006.01)
*B65D 33/25* (2006.01)

(58) Field of Classification Search
USPC ..... 206/242, 260, 265, 271; 383/33, 34, 78, 383/84, 85, 203, 204, 207, 209
See application file for complete search history.

(56) References Cited

U.S. PATENT DOCUMENTS

| | | | | |
|---|---|---|---|---|
| 6,082,897 | A * | 7/2000 | Galomb | B65D 31/10 24/585.12 |
| 6,132,089 | A * | 10/2000 | Galomb | B65D 33/1658 383/120 |
| 6,168,312 | B1 * | 1/2001 | Hausslein | B65D 33/1666 383/68 |
| 6,213,645 | B1 | 4/2001 | Beer | |
| 6,231,235 | B1 * | 5/2001 | Galomb | B65D 31/10 383/120 |
| 2004/0208399 | A1 * | 10/2004 | Linneweil | B65D 31/10 383/68 |
| 2004/0208400 | A1 * | 10/2004 | Linneweil | B65D 31/10 383/68 |
| 2005/0103798 | A1 | 5/2005 | Luigi | |
| 2005/0244083 | A1 | 11/2005 | McMahon et al. | |
| 2007/0092167 | A1 | 4/2007 | Tilman et al. | |

FOREIGN PATENT DOCUMENTS

| | | |
|---|---|---|
| FR | 605 183 | 5/1926 |
| GB | 125 874 | 5/1919 |
| GB | 440 598 | 1/1936 |
| GB | 1454695 A | 3/1976 |
| WO | WO 2006/068523 A1 | 6/2006 |
| WO | WO 2014/204301 A1 | 12/2014 |

OTHER PUBLICATIONS

International Search Report and Written Opinion for PCT/IB2017/053769, issued by the European Patent Office, dated Sep. 25, 2017; 14 pgs.

"Snapquick™" Ecolean AB, Sweden; 2018 [online] downloaded Nov. 21, 2018; https://www.ecolean.com/lightweight-packages/snapquick/: 5 pgs.

* cited by examiner

RESEALABLE TOBACCO POUCH

This application is the § 371 U.S. National Stage of International Application No. PCT/IB2017/053769, filed 23 Jun. 2017, which claims the benefit of European Application No. 16177292.6, filed 30 Jun. 2016.

This disclosure relates to containers for housing tobacco, such as tobacco pouches having resealable openings.

Handmade cigarettes are made, usually by the smoker, by wrapping a rectangular sheet of cigarette paper of the length of the cigarette around loose tobacco. Cigarette papers for hand making may have a moisture activated adhesive strip along one long edge and are usually presented in a small package from which one paper protrudes through a slot. The papers are typically folded longitudinally and interleaved inside the packet so that removal of the protruding paper causes the next paper to protrude through the slot. The wrapping is often done by hand, by use of a cigarette rolling mat, or by use of a small hand operated machine. The handmade cigarette may optionally include a filter according to the smoker's preference.

Tobacco for handmade cigarettes is often supplied in pouch-style containers. Once the pouch is opened, the tobacco may begin to lose moisture and dry out. Some tobacco pouches are made from a flexible plastic film and have a flap that may be lifted to reveal an opening in the film for access to the tobacco. Some pouches may be resealable to maintain freshness of the tobacco or to prevent the tobacco from spilling out of the pouch. For example, some tobacco pouches are provided with a freshness seal that may be broken open or are provided with a plastic zip at the opening that is resealable.

It would be desirable to provide a simple tobacco pouch that stores a quantity of loose tobacco sufficient to make multiple handmade cigarettes. It would be desirable to limit the transfer of moisture to and from the tobacco. It would also be desirable to provide a stable opening to facilitate easy access to the tobacco and to mitigate accidental spills.

A packaged tobacco product of the invention includes a pouch defining and interior and having a front wall and a back wall connected to one another along opposing first and second edges. The pouch is configured to be opened along a top portion of the pouch to form an opening between the front wall, the back wall and the first and second side edges to provide access to the interior of the pouch. Tobacco material is contained in the interior of the pouch.

The pouch further comprises a closure assembly comprising first and second parts. The first part is on an exterior surface of the front wall of the pouch and extends substantially from the first side edge of the pouch to the second side edge of the pouch. The first part is configured to releasably attach to the second part. As the second part of the closure assembly is moved to attach to the first part of the closure assembly, a portion of the back wall of the pouch wraps around at least a portion of the second part of the closure assembly to seal the interior of the pouch between the front wall and the back wall. A mid portion of the first part of the closure assembly is configured to deflect upon application of force that causes the first end of the pouch to move toward the second end of the pouch. When the pouch is open, the deflection of the mid-portion of the first part of the closure assembly causes a mid-portion of the front wall of the pouch adjacent the opening to move away from a mid-portion of the back wall of the pouch adjacent the opening.

The pouches of the present invention preferably include a closure assembly that provides a seal to preserve moisture and freshness of tobacco material stored in the pouch. In addition, a pouch of the present invention preferably includes a purse like opening that provides a stable opening allowing for easy access to the tobacco material contained in the pouch. These and other advantages of various aspects of packaged tobacco products, pouches and closure assemblies of the invention will be readily understood by those of skill in the art upon reading the disclosure presented herein.

In an aspect of the invention, a pouch includes a closure assembly comprising a first part and a second part. The first part is on the front wall of the pouch. The second part is on either the front wall or the back wall of the pouch. The second part is closer to the opening than the first part. The first and second parts are resealably attachable to one another such that a surface of the first part interacts with a mating surface of the second part. The mating surfaces of the first and second parts, when the first and the second parts are detached, face away from the interior of the pouch. When the first and second parts are attached, the mating surface of the first part continues to face away from the interior of the pouch, and the mating surface of the second part faces the interior of the pouch. When the first and second parts are attached, a portion of the back wall wraps around at least a portion of the second part of the closure assembly to seal the pouch.

The closure assembly preferably sufficiently seals the opening of the pouch to prevent tobacco material from accidentally spilling out of the pouch. The closure assembly need not prevent fluid, such as air or moisture, transfer through the opening when the first and second parts are attached to one another. Preferably, the seal is sufficient to prevent or reduce the rate of moisture transfer between the outside of the pouch and the interior of the pouch through the opening sealed by the closure assembly. Accordingly, the freshness and moisture content of the tobacco material in the pouch may be better maintained when the opening is sealed by the closure assembly.

Preferably the first and second parts of the closure assembly are attachable and detachable from one another to seal the opening at least about 5 times or at least about 10 times, or at least about 20 times or at least about 30 times. The term "reseal" refers to securely closing the access opening so that human force or action is required to open the resealable access opening.

The first part and the second part of the closure assembly may be any suitable distance from one another when they are detached and the pouch is opened or when the pouch has not yet been opened by a consumer. Preferably, the distance between the first and second parts, when they are detached from one another, is sufficient to allow a desired seal to form when the back wall is folded over the second part when the first and second parts are attached.

The second part of the closure assembly is closer to the opening than the first part of the closure assembly. The first and second parts each have a bottom and a top closer to the opening than the bottom. The bottom of the second part is closer to the opening than the top of the first part. Both the first part and the second part are below the opening.

In some examples where the first part and the second part of the closure assembly are on the front wall of the pouch, the first and second parts are adjacent to one another. That is, the bottom of the second part may be adjacent to the top of the first part. For example, the closure assembly may comprise a living hinge and the hinge may separate the first and second parts.

In some examples where the first part of the closure assembly is on the front wall of the pouch and the second part is on the back wall, the first and second parts are separated by a sufficient vertical distance (from the bottom of the pouch to the opening) to allow the second part to be rotated approximately 360 degrees around its longitudinal axis for mating with the first part on the front wall, while providing a desired seal around the opening.

Configurations where the second part of the closure assembly is on the back wall of the pouch may provide for a better seal than configurations where the second part of the closure assembly is on the front wall, as the second part rotates approximately an additional 180 degrees about its longitudinal axis to mate with the first part when the second part is on the back wall. The additional 180 degree rotation may create an extra fold for sealing the pouch around the opening.

The first and second parts of the closure assembly preferably extend at least the length of the opening. Preferably, the opening extends across the width of the pouch from a first sealed edge to a second sealed edge to maximize the size of the opening to facilitate access to the tobacco material in the pouch. Thus, the first and second parts of the closure assembly preferably extend from or substantially from the first sealed edge to the second sealed edge of the pouch.

The first and second parts of the closure assembly may be attached to an outer surface of the front wall, or front wall and back wall depending on the configuration, in any suitable manner. For example, the first and second parts may be attached to the front wall, or the front wall and the back wall, by an adhesive, heat sealing by, for example, infrared or hot air, ultrasonic welding, or the like. Preferably, the first and second parts are attached to the front wall or the front wall and the back wall along the entire length of the first and second parts of the closure assembly.

The first and second parts may be made of any suitable material, such as a thermoplastic material. One example of a suitable thermoplastic material is high density polyethylene. Preferably, the material may be formed to have a living hinge as discussed below and may survive five or more, ten or more, twenty or more, or thirty or more opening and closing cycles.

The first part, or the first part and the second part, of the closure assembly comprises a mid-portion configured to deflect upon application of force that causes the first side edge of the pouch to move toward the second side edge of the pouch. Deflection of the mid-portion of the first part of the closure assembly causes a mid-portion of the front wall of the pouch adjacent the opening to move away from a mid-portion of the back wall of the pouch adjacent the opening. If the second part of the closure assembly is on the front wall of the pouch, the second part preferably also comprises mid-portion configured to deflect upon application of force that causes the first side edge of the pouch to move toward the second side edge of the pouch. Deflection of the mid-portion of the second part of the closure assembly causes a mid-portion of the front wall of the pouch adjacent the opening to move away from a mid-portion of the back wall of the pouch adjacent the opening.

If the second part of the closure assembly is on the back wall of the pouch, the second part may comprise mid-portion configured to deflect upon application of force that causes the first side edge of the pouch to move toward the second side edge of the pouch. Deflection of the mid-portion of the second part of the closure assembly causes a mid-portion of the back wall of the pouch adjacent the opening to move away from a mid-portion of the front wall of the pouch adjacent the opening.

Accordingly, the closure assembly may be pinched to provide enhanced access to the tobacco material within the pouch in a purse like manner. The closure assembly, which is preferably more rigid than the material forming the front and back wall of the pouch, may provide enhanced control of opening of the pouch relative to a pouch, which is made of the more flexible material, without the closure assembly.

The mid-portion of the first part of the closure assembly, or the mid-portions of the first and second parts of the closure assemblies, may comprise a living hinge. Preferably, the living hinge is capable of withstanding 5 or more, 10 or more, 20 or more, or 30 or more opening and closing cycles. The living hinge may be transverse to the longitudinal axis of the first or second part of the closure element and may be parallel to the first and second side edges of the pouch.

The first and second parts of the closure assembly comprise complementary mating surfaces. The mating surfaces of the first and second parts, when the first and the second parts are detached and the pouch is open, face away from the interior of the pouch. When the first and second parts are attached, the mating surface of the first part continues to face away from the interior of the pouch, and the mating surface of the second part faces the interior of the pouch. When the first and second parts are attached, a portion of the back wall wraps around at least a portion of the second part of the closure assembly to seal the pouch.

The first and second parts of the closure assembly may have any suitable complementary mating features. For example, mating surfaces may comprise complementary male and female features such as snap engagement features, a non-permanent adhesive and a contact surface, a microsuction structure, a look and hook structure, magnetic elements, or the like. The interaction of the mating surfaces is sufficiently strong to withstand any biasing force of the material of the back wall due to wrapping the back wall of the pouch around second part of the closure assembly. Preferably, the mating surfaces comprise complementary male and female features.

Examples of suitable non-permanent adhesives include pressure sensitive adhesives. For example, the adhesive may include a low tack adhesive comprising a fast-curing acrylic oligomer (epoxidized soy bean oil acrylate), a slower-curing, reactive tack-control agent (urethane acrylate) and an optional elastomeric component (methacrylated polybutylene), commercially available from Mondelez International, for example.

A mating surface of the first or second part of the closure assembly may include any suitable microsuction structure. The term "microsuction structure" is used herein to refer to an element comprising a flexible material having a plurality of micro cavities, microsuction cups or microbubbles on the material's external surface. The walls of the microsuction structure are deformable, such that, when the external surface of the material is pressed against a contact surface, a sealed environment of reduced pressure is formed between the walls of the cavities and the contact surface. This provides a suction force between the walls of the cavities and the contact surface. The microsuction structure may have a diameter of from about 5 microns to about 300 microns. The material forming the microsuction structure may be formed of an expanded resin having a plurality of internal air bubbles. The material may be provided as a layer of a sheet-like article on the surface of the first or second part of the closure assembly. The layer may have a thickness of from about 30 microns to about 500 microns. The microsuction structure may be any microstructure that utilizes suction to form a seal. Microsuction structures are commercially available under the trade designation Yupo Tako from Yupo Europe GmbH.

The complementary mating features may comprise any suitable magnetic material and opposing magnetic material. The magnetic material may comprise one or more magnets. Preferably the magnetic material comprises magnetic nanoparticles dispersed in a polymeric material. The polymeric material preferably may be a light or heat curable polymeric adhesive. The magnetic nanoparticles preferably are magnetic metal or magnetic metal oxide nanoparticles. The magnetic metal may include iron, cobalt, nickel and alloys of iron, cobalt or nickel. The size of the nanoparticles may be about 1 nanometer to about 100 nanometres.

A sealing element may include any suitable hook and loop fastener. Hook and loop fasteners are commercially available from under the trade designation Velcro from Velcro GmbH.

Regardless of the complementary mating features employed, the mating surfaces of the first and second parts of the closure assembly preferably maintain sufficient interaction to prevent tobacco material in the pouch from accidentally spilling out of the pouch. The seal need not prevent fluid, such as air or moisture, transfer between the interior of the pouch and outside the pouch through the sealed opening. Preferably, the seal is sufficient to prevent or reduce the rate of moisture transfer between the outside of the pouch and the interior of the pouch to maintain freshness of the tobacco material maintained within the pouch. Preferably, the seal is sufficient to maintain the moisture level of the tobacco material in the pouch.

The pouch comprises a front wall and a back wall sealed at first and second side edges. The front wall and the back wall of the pouch are preferably sealed together at the first and second side edges along the entire length of the first and second sides. Prior to opening by a consumer, the front wall and the back wall extend beyond the closure assembly to a top edge of the pouch. The front wall and the back wall are preferably sealed together at the top edge of the pouch.

The pouch may include a tear strip or other tear element to allow a consumer to tear off a portion of the pouch above the closure assembly to create the opening for accessing the tobacco material in the pouch. For example, the front wall may comprise a line of weakness between the top edge of the pouch and the closure assembly, and the back wall may comprise a line of weakness aligned with front wall line of weakness. Tearing the pouch along the lines of weakness creates the opening of the pouch. The front wall and the back wall together may form a tearing tab or notch aligned with the lines of weakness of the front and back walls.

The pouch is preferably a stand-up pouch. A stand-up pouch may include a bottom that is self-supporting. For example, the bottom of the pouch may include a round bottom gusset, k-seal, plow bottom, or the like.

The pouches of the invention may be made of any suitable material or materials. Preferably, the front wall, the back wall, and the bottom, if present, are made from the same one or more materials. Preferably the front wall, the back wall and the bottom, if present, are made formed of a flexible substrate material from a sheet of material. The sheet may be formed of any flexible material or combination of materials. The material or materials may be capable of being heat-sealed to form a permanent seal that may be airtight. Preferably, the material or materials have sufficient moisture barrier properties to prevent loss of moisture from the tobacco material, during storage or use and to prevent the ingress of water or vapor into or out of the pouch. In addition, the material or materials forming the front wall, the back wall, and the bottom, if present, are preferably impermeable to microorganisms. The pouch may have regions that are transparent or opaque or may be metallized or may be entirely transparent or opaque or may be entirely metallized.

The front wall, the back wall, and the bottom, if present, may be formed from a single layer material, or a laminate material, for example a metal and plastic laminate. Suitable materials include single layer materials like polyolefins such as polyesters, in particular, polyethylene, polypropylene, polyethylene terephthalate (PET), linear low-density polyethylene (LLDPE), high-density polyethylene (HDPE), ultra high-density polyethylene (UHDPE), orientated polypropylene (OPP), cast polypropylene (CPP), for example.

Other examples include multiple layer laminates, preferably double or triple layer laminates. The multilayer laminates preferably include at least one layer of polyethylene, metalized polyethylene, polyethylene terephthalate or metalized polyethylene terephthalate and other suitable laminates, e.g. cellulose-based laminates with limited water-vapour permeability. The water-vapour permeability is measured by the vapour-water transmission rate in accordance with ISO 2528: 1995. Preferably the vapor-water transmission rate is measured at 25 degrees Celsius and 60 percent relative humidity.

Preferably the vapor-water transmission rate is less than about 20 grams per square meter per 24 hours, preferably less than about 15 grams per square meter per 24 hours, further preferred less than about 10 grams per square meter per 24 hours, even more preferably less than about 8 grams per square meter per 24 hours, most preferably less than 15 about 6 grams per square meter per 24 hours.

Preferably the front wall, the back wall, and the bottom, if present, are formed from a multiple layer laminate, preferably double or triple layer laminates. The multilayer laminates preferably include at least one layer of polyolefin such as, polyethylene, metalized polyethylene, polyethylene terephthalate or metalized polyethylene terephthalate or other suitable laminates, e.g. cellulose-based laminates with limited water-vapour permeability. Preferably heat sealing forms a hermetic seal.

Examples of two layer laminate sheet material includes independently selecting two layers of the following materials: polyethylene, polypropylene, polyethylene terephthalate (PET), orientated polypropylene (OPP), cast polypropylene (CPP), metallized cast polypropylene (Met CPP), and metallized polyethylene (Met PE) for example.

Examples of three layer laminate sheet material includes independently selecting three layers of the following materials: polyethylene, polypropylene, polyethylene terephthalate (PET), metallized polyethylene terephthalate (Met PET), orientated polypropylene (OPP), cast polypropylene (CPP), metallized cast polypropylene (Met CPP), and metallized polyethylene (Met PE) for example.

Preferably the front wall, the back wall, and the bottom, if present, are formed of a laminate sheet material formed of a layer of orientated polypropylene (OPP), polyethylene terephthalate (PET) optionally metallized polyethylene terephthalate (Met PET), and polyethylene.

The front wall, back wall and bottom, if present, may be formed of PET having a sheet thickness in a range from about 10 microns to about 50 microns. One example of a suitable three-layer laminated sheet material for forming the pouch comprises a first layer of about 40 grams per square meter of paper, a second layer of metallized about 12 micron thick PET, and a third layer of about 60 micron thick low density polyethylene.

The pouches of the invention may be suitable for storing a wide variety of tobacco or smokable materials, including one or more tobacco types. The tobacco material may be in any suitable form and may include tobacco cut from tobacco leaves, reconstituted tobacco material, or both. The tobacco material typically has a cut width of between about 0.1 and about 0.9 millimetres, more preferably between about 0.3 and about 0.6 millimetres and may be pasteurized.

Preferably, the moisture content of the tobacco material within the pouch is between about 15 percent and about 22 percent by weight, more preferably between about 16 percent and about 20 percent by weight as measured two weeks after the filling of the pouch with the tobacco material. The amount of tobacco material in the pouch preferably has a weight of between about 10 grams and about 500 grams, more preferably between about 20 grams and about 60 grams.

All scientific and technical terms used herein have meanings commonly used in the art unless otherwise specified. The definitions provided herein are to facilitate understanding of certain terms used frequently herein.

The terms "upper," "lower," "side," "top," "bottom," and other terms are used to describe relative positions of the pouch. When describing a pouch according to the present invention, these terms are used irrespective of the orientation of the pouch being described. However, with reference to a stand-up pouch, the pouch is configured to stand upright on the bottom with the top being openable to allow access to the contents of the pouch.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

The schematic drawings are not necessarily to scale and are presented for purposes of illustration and not limitation. The drawings depict one or more aspects described in this disclosure. However, it will be understood that other aspects not depicted in the drawing fall within the scope and spirit of this disclosure. Referring now to the drawings, in which some aspects of the present invention are illustrated.

Figure 1:
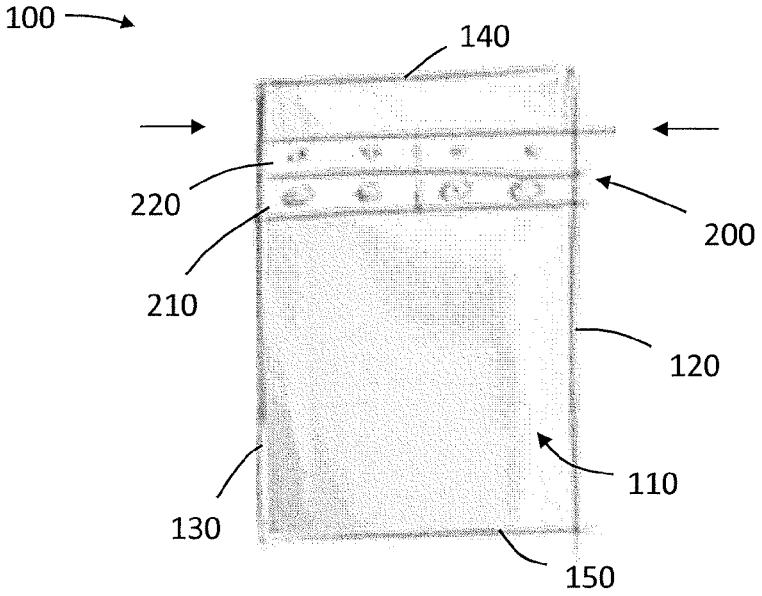
FIG. 1 is a schematic front view of an example of a sealed tobacco pouch prior to opening by a consumer.
Figure 2:
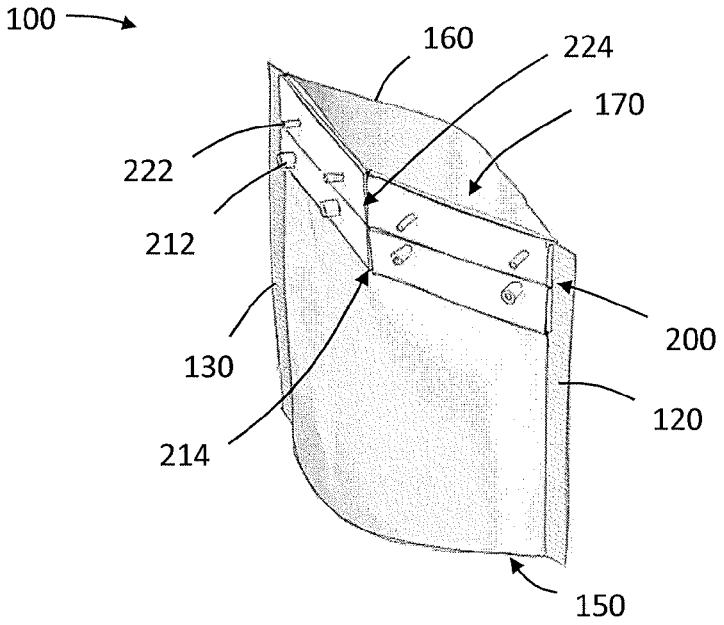
FIG. 2 is a schematic perspective view of an example of the tobacco pouch in FIG. 1 showing the pouch opened.
Figure 3:
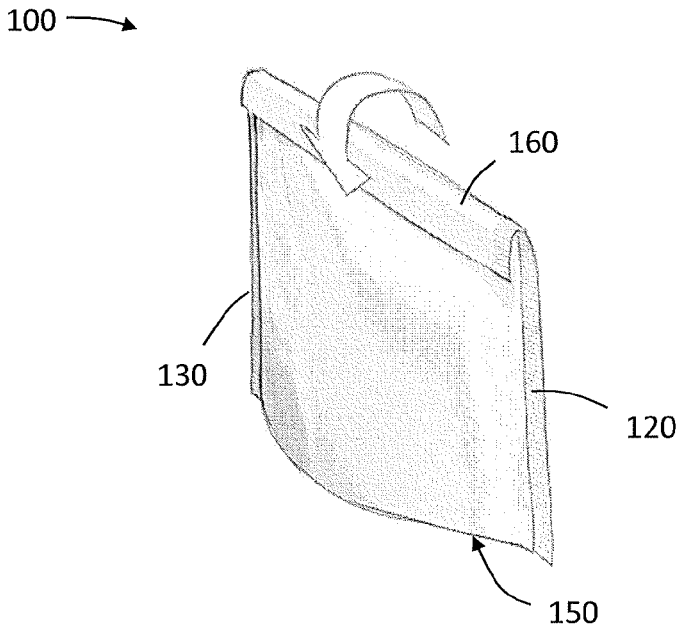
FIG. 3 is a schematic side view of an example of the tobacco pouch in FIG. 2 showing the back wall folded over the second part of the closure element.

Referring now to FIGS. 1-3, a stand-up pouch 100 includes a front wall 110 and a back wall 160 sealed along first 120 and second 130 side edges. The pouch 100 includes a reinforced bottom 150. The bottom 150 may be reinforced by, for example, a gusset. The bottom 150 is sealed to the front wall 110 and back wall 160 or is formed from a continuous sheet of material with the front wall 110 and the back wall 160.

Prior to opening by a consumer, the pouch 100 has a sealed top edge 140 formed by sealing the front wall 110 and the back wall 160 (see, for example, FIG. 1). The arrows in FIG. 1 indicate a cut line or a tear line wherein the consumer may cut or tear open the pouch 100 to reveal an opening 170 to the interior of the pouch 100 as shown in FIG. 2.

The pouch 100 includes a closure assembly having a first part 210 and a second part 220. The second part 220 is closer to the opening 170 (or the edge defining the opening 170) than the first part 210. The bottom of the second part 220 is closer to the opening 170 than the top of the first part 210. In the depicted embodiment, the first 210 and second 220 parts are separated by a living hinge. The first 210 and second 220 parts each have a mid-portion 214, 224 configured to deflect away from the interior of the pouch 100 when the closure assembly is pinched between the first 120 and second 130 edges of the pouch 100. The first 210 and second 220 parts may have a living hinge at the mid-portion 214, 224.

The first 210 and second 220 parts are attached to the front wall 110 such that a mid-portion of the front wall 110 in proximity to the opening 170 deflects away from the interior of the pouch 100 when the closure assembly 200 is pinched, due to deflection of the mid-portions 214, 224 of the first 210 and second 220 parts of the closure assembly 200. Thus, a wide opening 170 is created allowing a consumer easy access to tobacco material stored in the pouch 100.

The first 210 and second 220 parts of the closure assembly 200 have complementary mating surfaces that face away from the interior of the pouch 100. In the depicted embodiment, the first part 210 includes female features 212 and the second part 220 includes male features 222 configured to engage the female features 212 of the first part 210. The second part 210 may be rotated about 180 degrees along its longitudinal axis so that the male features 222 may be inserted into the corresponding female 212 features of the first part 210. When the mating surfaces of the first 210 and second 220 part are engaged, a portion of the back wall 160 of the pouch 100 wraps around the second part 220 of the closure assembly 200 to seal the opening 170 (see, for example, FIG. 3).

Figure 4A:
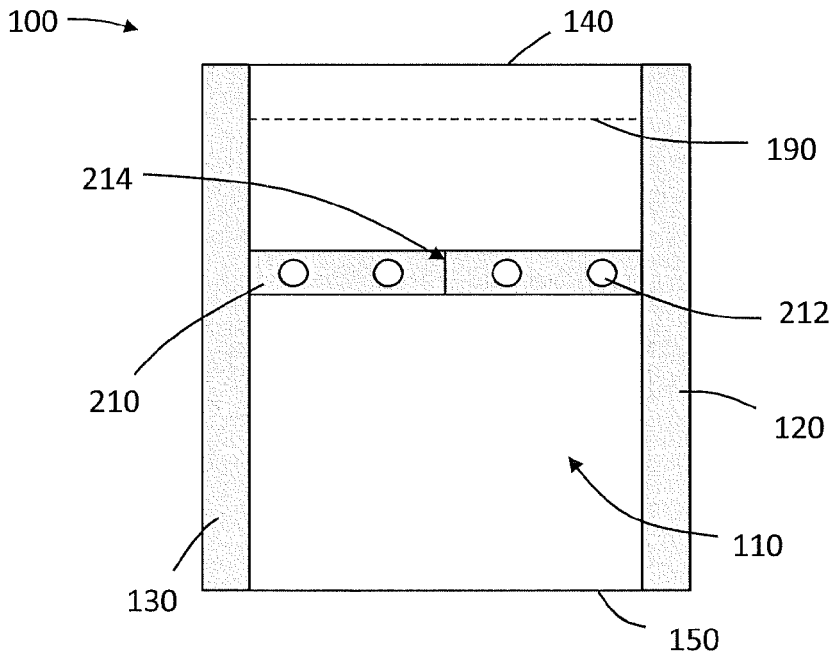
FIG. 4A is a schematic front view of an example of a sealed tobacco pouch prior to opening by a consumer.
Figure 4B:
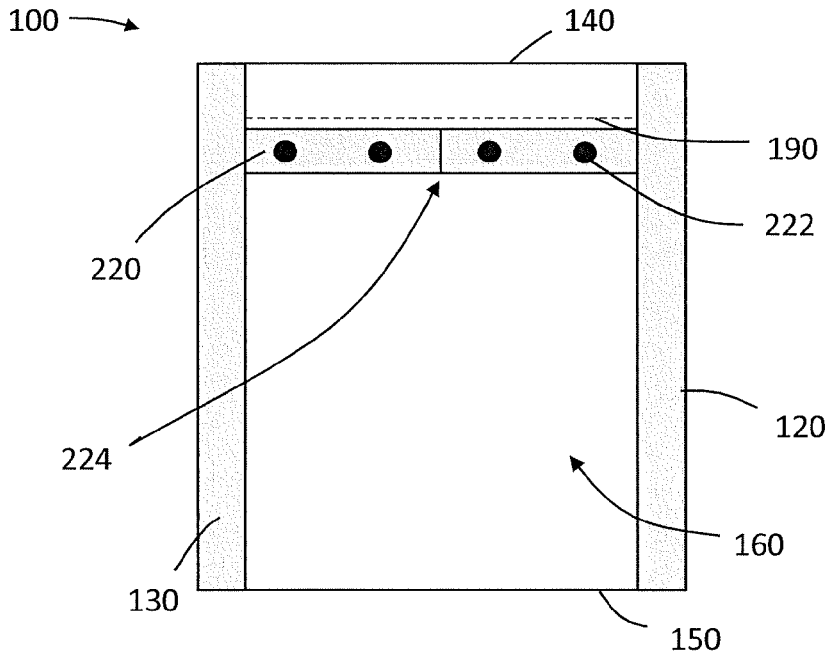
FIG. 4B is a schematic back view of an example of the sealed tobacco pouch depicted in FIG. 4A.

Referring now to FIGS. 4A-4B, an alternative example of a pouch 100 is shown. The pouch includes a front wall 110 sealed to a back wall 160 along first 120 and second 130 side edges. The pouch 100 also includes a sealed top edge 140 and bottom 150. The front 110 and back 160 include a line of weakness 190 defining a tear line to allow a consumer to tear off a top portion of the pouch 100 to open the pouch. The line of weakness 190 is above the second part 220 of the closure assembly. Alternatively, a marking on the pouch to provide a consumer with a visual cue regarding where the pouch 100 should be cut to open the pouch may be provided rather than the line of weakness 190.

The closure assembly includes first 210 and second 220 parts. After the consumer opens the pouch 100 along line 190, the second part 220 is closer to the opening than the first part 210. The first part 210 is affixed to the front wall 110 and the second part 220 is affixed to the back wall 160. The first 210 and second 220 parts include complementary mating surfaces that each face away from the interior of the pouch 100 when the pouch is open. In the depicted embodiment, the second part 220 includes male features 222 configured to be received by corresponding female features 212 of the first part 210. Rotation of the second part 220 of about 360 degrees along its longitudinal axis allows for insertion of the male features 222 of the second part 220 into the female 212 features of the first part 210. Such rotation causes a portion of the back wall 160 to wrap around the second part 220 and seal the opening. The resulting pouch with sealed opening may appear generally a depicted in FIG. 3.

The additional rotation of the second part 220 due to the second part being on the back wall 160 relative to the second part being on the front wall may result in an enhanced seal about the opening due to an extra fold.

The specific embodiments described above are intended to illustrate the invention. However, other embodiments may be made without departing from the spirit and scope of the invention as defined in the claims, and it is to be understood that the specific embodiments described above are not intended to be limiting.

The invention claimed is:

1. A packaged tobacco product, comprising:

a pouch (i) defining an interior, (ii) having a front wall and a back wall connected to one another along opposing first and second side edges, the front wall having an exterior surface, and (iii) configured to be opened along a top portion of the pouch to form an opening between the front wall, the back wall and the first and second side edges to provide access to the interior of the pouch;

tobacco material contained in the interior of the pouch; and a closure assembly comprising first and second parts, wherein the first part is on the exterior surface of the front wall of the pouch and extends substantially from the first side edge of the pouch to the second side edge of the pouch, and wherein the first part is configured to releasably attach to the second part, wherein, as the second part of the closure assembly is moved to attach to the first part of the closure assembly, a portion of the back wall of the pouch wraps around at least a portion of the second part of the closure assembly to seal the interior of the pouch between the front wall and the back wall, wherein a mid-portion of the first part of the closure assembly is configured to deflect upon application of force that causes the first side edge of the pouch to move toward the second side edge of the pouch, and wherein, when the pouch is open, the deflection of the mid-portion of the first part of the closure assembly causes a mid-portion of the front wall of the pouch adjacent the opening to move away from a mid-portion of the back wall of the pouch adjacent the opening.

2. A packaged tobacco product according to claim 1, wherein the first part of the closure assembly comprises a living hinge at the mid-portion.

3. A packaged tobacco product according to claim 1, wherein the second part of the closure assembly is on the exterior surface of the front wall of the pouch and extends substantially from the first side edge of the pouch to the second side edge of the pouch, and wherein the second part of the closure assembly is closer to the opening than the first part of the closure assembly.

4. A packaged tobacco product according to claim 1, wherein the second part is on the exterior surface of the back wall of the pouch and extends substantially from the first side of the pouch to the second side of the pouch, and wherein the second part of the closure assembly is closer to the opening than the first part of the closure assembly.

5. A packaged tobacco product according to claim 4, wherein a mid-portion of the second part of the closure assembly is configured to deflect upon application of force that causes the first side edge of the pouch to move toward the second side edge of the pouch, and wherein, when the pouch is open, the deflection of the mid-portion of the second part of the closure assembly causes a mid-portion of the back wall of the pouch adjacent the opening to move away from a mid-portion of the front wall of the pouch adjacent the opening.

6. A packaged tobacco product according to claim 5, wherein the second part of the closure assembly comprises a living hinge at the mid-portion.

7. A packaged tobacco product according to claim 1, wherein a fluid permeable seal is formed between the front wall and the back wall when the portion of the back wall of the pouch wraps around at least the portion of the closure assembly.

8. A packaged tobacco product according to claim 1, wherein a hermetic or near hermetic seal is formed between the front wall and the back wall when the portion of the back wall of the pouch wraps around at least the portion of the closure assembly.

9. A packaged tobacco product according to claim 1, wherein the front wall of the pouch and the back wall of the pouch are sealed together at the first and second side edges along the entire length of the first and second sides.

10. A packaged tobacco product according to claim 1, wherein prior to opening by a consumer, the front wall and the back wall extend beyond the closure assembly to a top edge of the pouch.

11. A packaged tobacco product according to claim 10, wherein front wall and the back wall are sealed together at the top edge.

12. A packaged tobacco product according to claim 10, wherein the front wall comprises a line of weakness between the top edge of the pouch and the closure assembly and wherein the back wall comprises a line of weakness aligned with front wall line of weakness, wherein tearing the pouch along the lines of weakness creates the opening of the pouch.

13. A packaged tobacco product according to claim 12, wherein the front wall and the back wall together form a tearing notch aligned with the lines of weakness of the front and back walls.

14. A packaged tobacco product according to claim 1, wherein the first part of the closure assembly comprises a plurality of snap features and the second part of the closure assembly comprises a plurality of complementary snap features configured to mate with the snap features of the first part of the closure assembly when the first part is attached to the second part of the closure assembly.

15. A packaged tobacco product according to claim 1, wherein the first part of the closure assembly comprises a microsuction structure and the second part of the closure assembly comprises a microsuction structure receptor surface, or wherein the second part of the closure assembly comprises a microsuction structure and the first part of the closure assembly comprises a microsuction structure receptor surface;

wherein the first part of the closure assembly comprises a pressure sensitive adhesive and the second part of the closure assembly comprises a pressure sensitive adhesive receptor surface, or wherein the part of the closure assembly comprises a pressure sensitive adhesive and the first part of the closure assembly comprises a pressure sensitive adhesive receptor surface;

wherein the first part of the closure assembly comprises a magnetic material and the second part of the closure assembly comprises an opposing magnetic material; or wherein the first part of the closure assembly comprises a hook or loop part of a hook and loop fastener and the second part of the closure assembly comprises the opposing loop or hook part of the hook and loop fastener.

* * * * *